US009831051B2

(12) United States Patent
Maier

(10) Patent No.: US 9,831,051 B2
(45) Date of Patent: Nov. 28, 2017

(54) KEYBOARD COMPRISING MULTIPLE STABILIZED TILE-SHAPED KEYS

(71) Applicant: FM MARKETING GMBH, Neumarkt am Wallersee (AT)

(72) Inventor: Ferdinand Maier, Neumarkt am Wallersee (AT)

(73) Assignee: fm marketing gmbh, Neumarkt am Wallersee (AT)

( * ) Notice: Subject to any disclaimer, the term of this patent is extended or adjusted under 35 U.S.C. 154(b) by 0 days.

(21) Appl. No.: 15/101,771

(22) PCT Filed: Dec. 5, 2014

(86) PCT No.: PCT/EP2014/076746
§ 371 (c)(1),
(2) Date: Jun. 3, 2016

(87) PCT Pub. No.: WO2015/082693
PCT Pub. Date: Jun. 11, 2015

(65) Prior Publication Data

US 2016/0379772 A1 Dec. 29, 2016

(30) Foreign Application Priority Data

Dec. 5, 2013 (DE) ..... 10 2013 018 156

(51) Int. Cl.
*H01H 13/704* (2006.01)

(52) U.S. Cl.
CPC ..... *H01H 13/704* (2013.01); *H01H 2205/024* (2013.01); *H01H 2205/026* (2013.01); *H01H 2205/032* (2013.01); *H01H 2209/006* (2013.01); *H01H 2215/012* (2013.01); *H01H 2217/016* (2013.01); *H01H 2229/028* (2013.01)

(58) Field of Classification Search
CPC ..... H01H 13/704; H01H 2205/024; H01H 2205/026; H01H 2205/032; H01H 2209/006; H01H 2215/012; H01H 2217/016; H01H 2229/028
USPC ..... 200/5 A, 511, 512, 514, 517, 341
See application file for complete search history.

(56) References Cited

U.S. PATENT DOCUMENTS 4,308,439 A * 12/1981 Itoh ..... B60K 37/06 200/292
4,503,294 A * 3/1985 Matsumaru ..... H01H 13/702 200/5 A
4,640,994 A * 2/1987 Komaki ..... H01H 13/702 200/264
5,193,669 A * 3/1993 Demeo ..... H01H 13/7006 200/302.2
2005/0052128 A1 3/2005 Nakanishi
2009/0014304 A1 1/2009 Arai
2009/0057121 A1 3/2009 Yoshida et al.
(Continued)

OTHER PUBLICATIONS

International Search Report, PCT/EP2014/076746, dated Feb. 10, 2015, 3 pages.

(Continued)

*Primary Examiner* — Edwin A. Leon
(74) *Attorney, Agent, or Firm* — Senniger Powers LLP

(57) ABSTRACT

The keyboard having a plurality of plate-shaped keys which are connected to actuators stabilizes the keys by all the keys and all the actuators being connected to a bending-elastic but tension-resistant band-like membrane.

18 Claims, 3 Drawing Sheets

(56) References Cited

U.S. PATENT DOCUMENTS

| | | | |
|---|---|---|---|
| 2009/0152083 | A1 | 6/2009 | Cheng et al. |
| 2009/0200148 | A1 | 8/2009 | Honmatsu et al. |
| 2010/0193343 | A1 | 8/2010 | Yoshida |
| 2010/0231519 | A1 | 9/2010 | Cebe |

OTHER PUBLICATIONS

Written Opinion, PCT/EP2014/076746, dated Feb. 10, 2015, 5 pages.

* cited by examiner

KEYBOARD COMPRISING MULTIPLE STABILIZED TILE-SHAPED KEYS

REFERENCE TO RELATED APPLICATIONS

This application is a U.S. national stage application of International Patent Application No. PCT/EP2014/076746, filed Dec. 5, 2014, and claims the benefit of priority of German Application No. 10 2013 018 156.9, filed Dec. 5, 2013, the entire disclosures of which are incorporated herein by reference.

FIELD OF THE INVENTION

This invention concerns a keyboard having a plurality of plate-shaped keys which are connected to an elastically deformable switching membrane via actuators.

BACKGROUND OF THE INVENTION

Such a keyboard is known from EP 1876620 A1. Said keyboard has a keypad having a plurality of plate-shaped, rigid keys which are guided displaceably in recesses of a cover plate. Each of said keys is connected to an associated actuator of a flexible switching membrane, with the switching membrane having for each key an electrically conductive layer which is respectively associated with a pair of switching contacts on a conductor board. The individual keys are adhered to the associated actuator.

Upon depression of a key the latter depresses the associated actuator whose electrically conductive contact area then touches the contact pair on the conductor board and thus closes an electrical contact. Upon release of the key the actuator and the switching membrane spring back to their starting positions and then open the associated electrical contact. The actuators and the switching membrane are made of rubber-elastic material and are hence flexible in all spatial directions, the consequence being that the plate-shaped, almost entirely rigid keys also carry out tilting or wobbling motions when they are subjected to a force not exactly in the center. Also, the keys can be displaced in a plane (X, Y) that is parallel to their surfaces. In so doing, they can get wedged and be jammed in the cover plate. Also, it is not ensured that the desired electrical contact is closed, since a "lopsided" depression of the key can convey to the user the impression that the key is completely depressed while in fact the associated actuator is insufficiently depressed and deformed to electrically connect the associated contact pair on the conductor board.

U.S. Pat. No. 4,520,248 A shows a keyboard having a plurality of keys respectively separated from each other by a gap and fastened to an elastic foam layer. On the side of the foam layer opposing the keys is arranged a switching membrane with electrically conductive regions which are held by spacers relative to a conductor board. Through the foam layer, the keys can also perform tilting or wobbling motions upon depression, which has the above-described disadvantages.

DE 10 2004 021 542 A1 shows a keyboard having rubber-elastic actuators which are respectively covered by a rigid cap, with the caps being guided displaceably in a cover layer.

SUMMARY OF THE INVENTION

The object of the invention is to improve the keyboard of the kind stated at the outset so as to enable a reliable key operation while keeping the construction simple. In particular, tilting or wobbling motions of the keys are to be prevented at least to such an extent that a reliable switching of the corresponding contact is always attained upon depression of the key.

This object is achieved by the features stated in claim 1. Advantageous embodiments and developments of the invention are to be found in the subclaims.

DETAILED DESCRIPTION OF PREFERRED EMBODIMENTS

The basic idea of the invention is to connect the plate-shaped, substantially rigid keys to the actuators through the intermediary of a band-like membrane. The band-like membrane is bending-elastic but substantially tension-resistant. Said band-like membrane stabilizes the keys and rubber-elastic actuators such that an off-center depression of a key does not lead to any appreciable wedging of the keys and thus a flawless switching function is given. A displacing of the keys parallel to their rest position plane (X, Y) is also prevented, because the band-like membrane is tension-resistant to the greatest possible extent. The fastening of the keys to the band-like membrane is preferably effected by adhering and in particular preferably by adhesive strips furnished with an adhesive coating on both sides. The connection between the actuators and the band-like membrane is also effected in the same manner.

According to a development of the invention, the area of the stated adhesive strips furnished with an adhesive coating on both sides is smaller than the area of the associated key and also smaller than the area of the actuators that comes in contact with the adhesive strips.

Preferably, the membrane consists of PET (polyethylene terephthalate) in a thickness of preferably 0.05 mm to 0.15 mm. Since said membrane is bending-elastic, the operation force of the individual keys that are connected by said membranes does not change and is still determined by the mechanical properties of the rubber-elastic actuators. However, wobbling or wedging of the almost entirely rigid keys is prevented.

Figure 1:
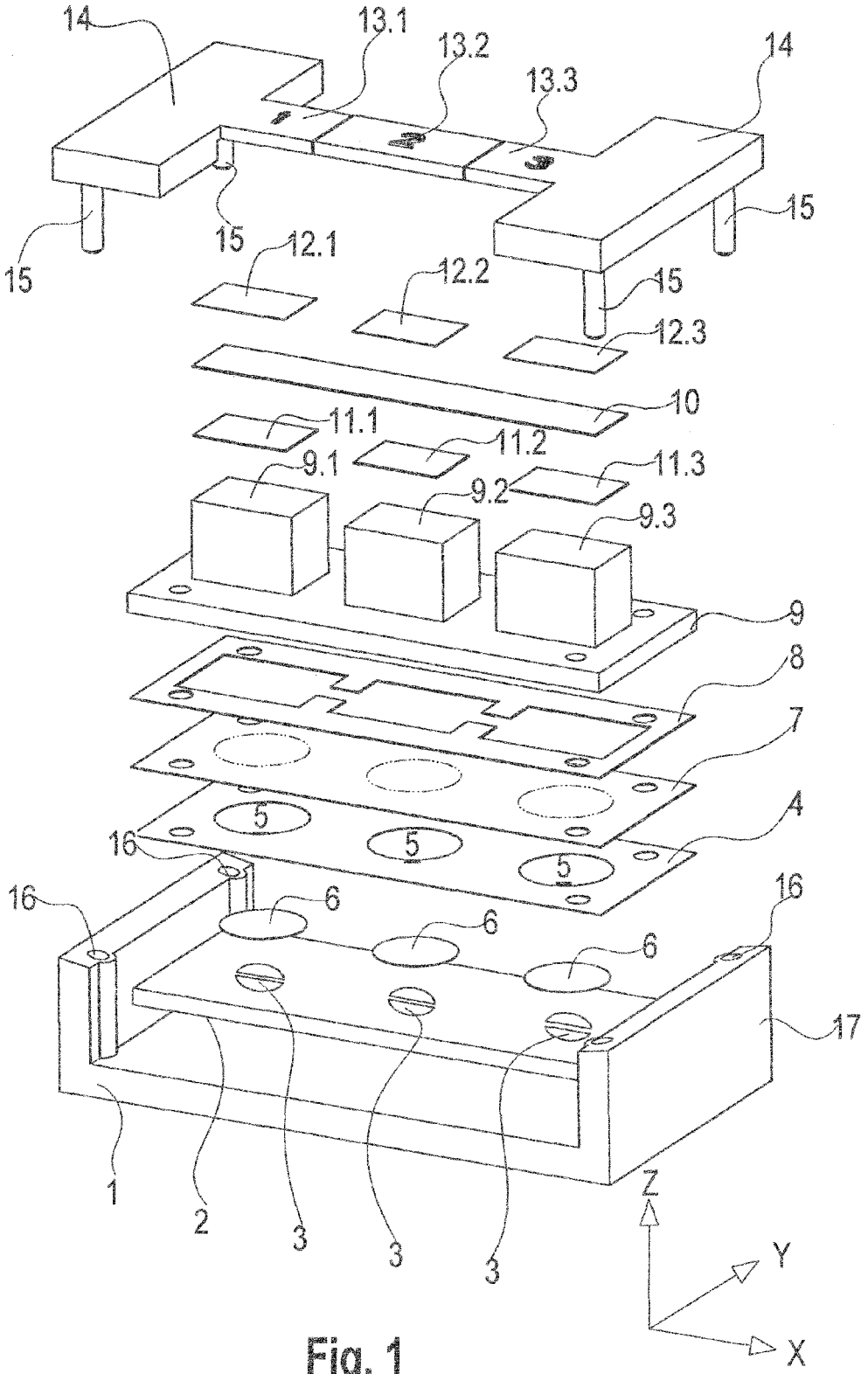
FIG. 1 a schematic exploded representation of a keyboard according to an embodiment example of the invention.

Hereinafter the invention will be explained in more detail with reference to an embodiment example in connection with the drawing. The keyboard of FIG. 1 has a housing 1 in which is arranged a conductor board 2 which has, inter alia, the electrical switching contacts 3 that are usual in a keyboard. Above the conductor board 2 is arranged a spacing membrane 4 which has openings 5 associated with the switching contacts 3, through which openings metal domes 6 protrude which are fastened to a switching membrane 7. The metal domes 6 are convexly bulged, adhered to the switching membrane 7 and so held by the spacing membrane 4 in the resting state of the keyboard that the switching contacts 3 associated with the respective metal domes 6 are not interconnected.

The switching membrane 7 with the metal domes fastened thereto is connected via an adhesive membrane 8 to a silicone plate 9 from which a plurality of actuators 9.1, 9.2 and 9.3 associated with the metal domes 6 protrude, which are integrally configured in the silicone plate 9. As explained in connection with FIG. 3, the actuators 9.1-9.3 have switching pins which protrude through openings of the adhesive membrane 8 and touch the switching membrane 7 at the places of the metal domes 6. When an actuator is depressed vertically in the direction of the Z axis, the associated metal dome 6 is deformed and touches the associated switching contacts 3, thereby closing an electrical switch.

The actuators 9.1-9.3 are connected at their upper side facing away from the conductor board 2 to a band-like membrane 10, this being effected by adhesive strips 11.1-11.3 which are coated with adhesive on both sides. Alternatively, the band-like membrane 10 can also be adhered directly to the actuators 9.1-9.3. It is important that the band-like membrane 10 interconnects all the actuators and is bending-elastic and tension-resistant. In other words, the membrane 10 can thus be bent in the Z direction but is substantially not deformable or stretchable in the XY plane.

The band-like membrane 10 is connected on its other side to plate-shaped keys 13.1, 13.2 and 13.3 via adhesive strips 12.1, 12.2 and 12.3, with said keys preferably being made of hard plastic and hence also only bendable to a very low extent. The two outer keys 13.1 and 13.3 represented in FIG. 1 can pass integrally into a housing cover 14, which is fastened to the housing 1 for example with pins 15 which engage bores 16 of housing side walls 17. The keys 13.1 and 13.3 are elastic in connection with the adjacent parts of the housing cover 14 and the fastening via the pins 15 to such an extent that the actuators 9.1 and 9.3 can be compressed to such a extent that the desired switching operation takes place.

Through the band-like membrane 10, which can also be connected to parts of the housing cover 14, the keys 13 and the actuators 9 are fixed in the X/Y plane and can be displaced in the Z direction, however, due to the bending elasticity of the membrane 10. Upon a "lopsided", i.e. off-center, depression of one of the keys, e.g. the key 13.2, wedging is likewise prevented to the greatest possible extent by the membrane 10, so that upon a lopsided depression of the key the latter is nevertheless moved substantially only in the Z direction.

Figure 2:
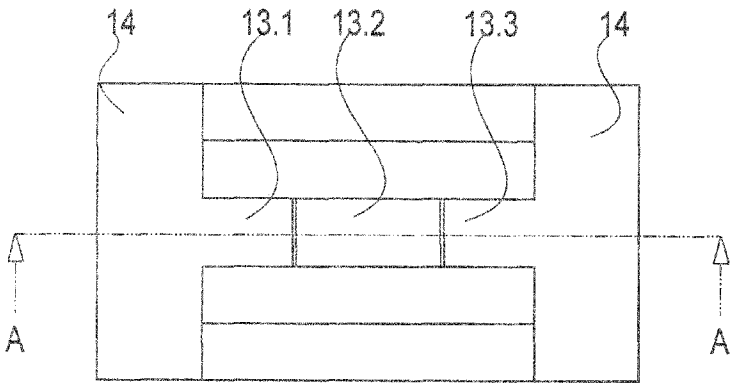
FIG. 2 a plan view of the keyboard of FIG. 1.

FIG. 2 shows a plan view of an embodiment example of a keyboard according to the invention, wherein only three keys 13.1, 13.2 and 13.3 are provided here, wherein the two keys 13.1 and 13.3 can also simultaneously be constituents of a housing cover 14. The principle of the invention can of course also be applied in other key arrangements, for example in those keyboards in which the keys are arranged in rows and columns in the form of a matrix, in which case the band-like membrane extends over the area of all the keys.

Figure 3:
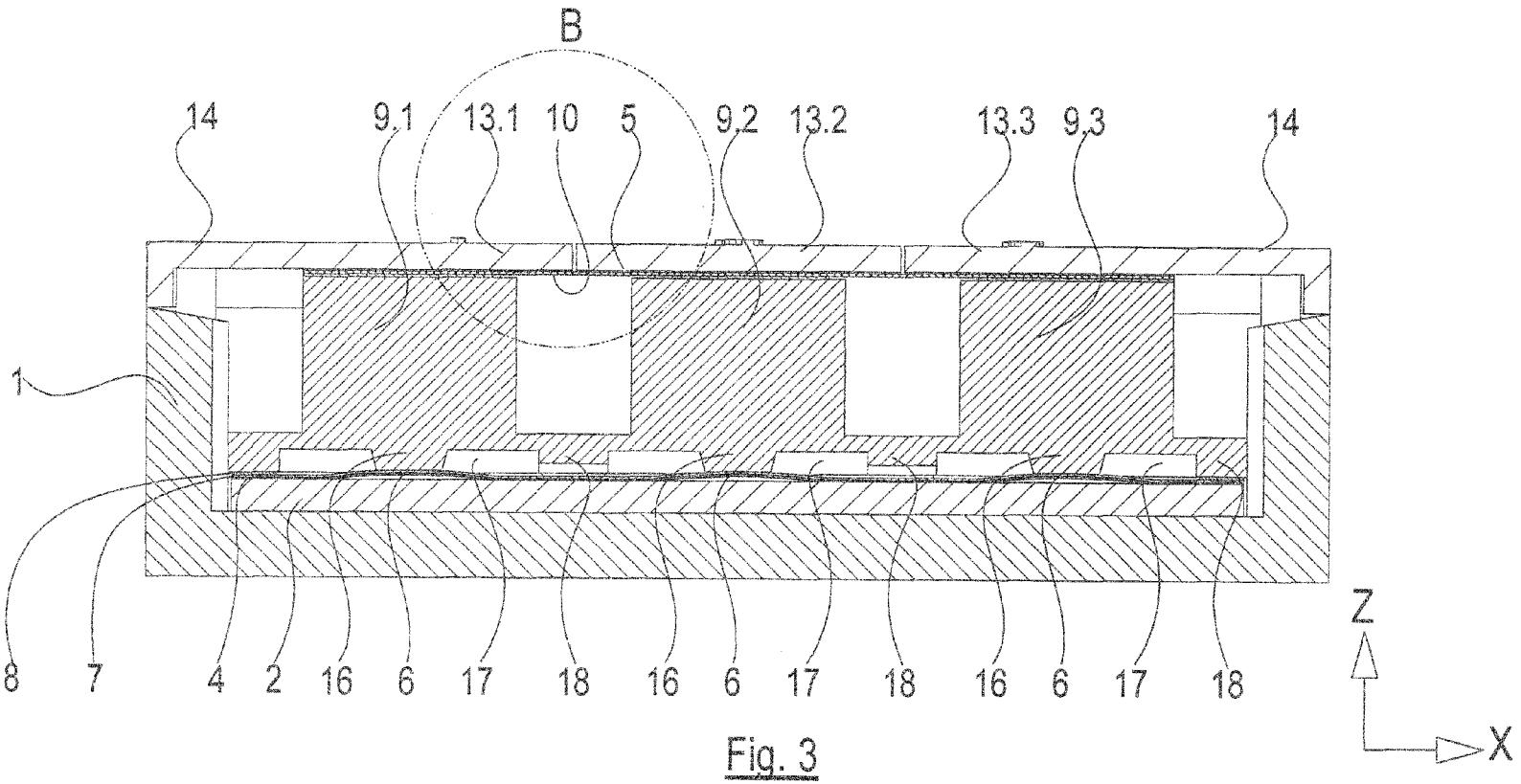
FIG. 3 a section along the line A-A of FIG. 2.

FIG. 3 shows a section along the line A-A of FIG. 2. One can see here the band-like membrane 10 arranged between the keys 13.1, 13.2 and 13.3 and the actuators 9.1, 9.2 and 9.3, with the adhesive strips 11 and 12 of FIG. 1 being omitted in FIG. 3 since the band-like membrane 10 can also be adhered directly to the actuators 9 and the keys 13.

The actuators 9 have on their underside facing the conductor board 2 a cylindrical or conical projecting pin 16, which is formed here by a recess 17 surrounding the pin 16. Said pin 16 protrudes toward the switching membrane 7 and the metal domes 6 bulged convexly toward the pins 16. Upon mechanical loading by the pin 16 the metal domes 6 can bulge to such an extent that they contact the associated switching contacts 3 on the conductor board 2, thereby also triggering a haptically perceptible effect, which is usually designated a "click" effect. In the embodiment example of FIG. 3, all the actuators 9.1, 9.2 and 9.3 are interconnected, this being effected via bars 18 which are partly supported on the adhesive membrane 8.

Figure 4:
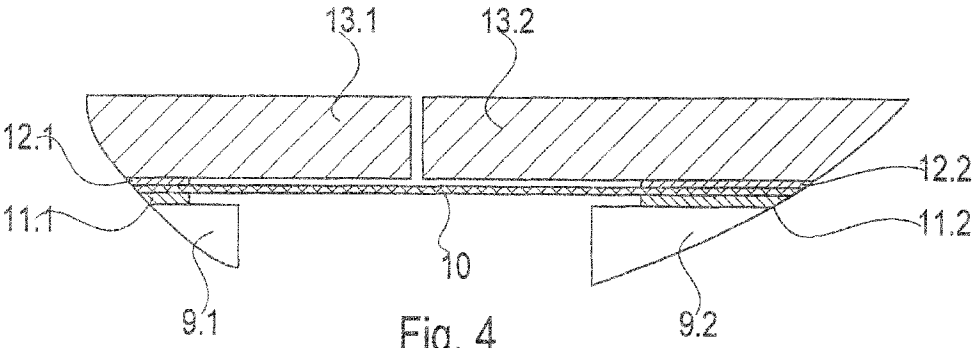
FIG. 4 an enlarged view of a region B of FIG. 3.

FIG. 4 shows an enlarged detail view of the detail B of FIG. 3 and in particular the transition region between the keys 13.1 and 13.2 which is bridged by the band-like membrane 10, with said membrane 10 being connected to the actuators 9 and the keys 13 by adhesive strips 11 and 12, with the adhesive strips 12 and 13 having a smaller surface than the actuators 9 and the keys 13.

Finally, it should also be pointed out that the term "key" does not necessarily designate an isolated member. For example, a closed ring connected to elastically deformable actuators can form four or more keys. It would also be conceivable to detach one or more segments of such a ring from the rest of the ring and define them as keys.

The invention claimed is:

1. A keyboard having a plurality of plate-shaped keys which are each connected via distinct actuators carried on a common plate to an elastically deformable switching membrane, with the switching membrane having electrically conductive metal domes which are associated with switching contacts of a conductor board, characterized in that all the keys and all the actuators associated with said keys are connected to a bending-elastic but tension-resistant band-like membrane;

wherein the actuators and the band-like membrane are positioned between the common plate and the keys.

2. The keyboard according to claim 1, characterized in that the membrane is connected to the keys and the actuators by adhesive strips respectively coated with adhesive on both sides.

3. The keyboard according to claim 2, characterized in that the adhesive strips respectively have a smaller area than the area of the key to be fastened and than the area of the actuator to be respectively fastened.

4. The keyboard according to claim 1, characterized in that the membrane consists of polyethylene terephthalate.

5. The keyboard according to claim 1, characterized in that the membrane has a thickness between 0.05 mm and 0.15 mm.

6. The keyboard according to claim 2, characterized in that the membrane consists of polyethylene terephthalate.

7. The keyboard according to claim 6 characterized in that the membrane has a thickness between 0.05 mm and 0.15 mm.

8. The keyboard according to claim 3, characterized in that the membrane consists of polyethylene terephthalate.

9. The keyboard according to claim 8 characterized in that the membrane has a thickness between 0.05 mm and 0.15 mm.

10. A keyboard having a plurality of plate-shaped keys which are each connected via distinct actuators carried on a common plate to an elastically deformable switching membrane, with the switching membrane having electrically conductive metal domes which are associated with switching contacts of a conductor board, characterized in that all the keys and all the actuators associated with said keys are connected to a bending-elastic but tension-resistant band-like membrane;

wherein the band-like member is located on a side of the actuators opposite to a side of the actuators on the common plate.

11. A keyboard having a plurality of plate-shaped keys which are each connected via distinct actuators carried on a common plate to an elastically deformable switching membrane, with the switching membrane having electrically conductive metal domes which are associated with switching contacts of a conductor board, characterized in that all the keys and all the actuators associated with said keys are connected to a bending-elastic but tension-resistant band-like membrane;

The keyboard according to claim 1 wherein the actuators are connected to the common plate on one side of the actuators and to the band-like membrane on an opposite side of the actuators.

12. The keyboard according to claim 10 wherein the actuators and the band-like membrane are positioned between the common plate and the keys.

13. The keyboard according to claim 2 wherein the band-like member is located on a side of the actuators opposite to a side of the actuators on the common plate.

14. The keyboard according to claim 2 wherein the actuators are connected to the common plate on one side of the actuators and to the band-like membrane on an opposite side of the actuators.

15. The keyboard according to claim 11 wherein the actuators and the band-like membrane are positioned between the common plate and the keys.

16. The keyboard according to claim 3 wherein the band-like member is located on a side of the actuators opposite to a side of the actuators on the common plate.

17. The keyboard according to claim 3 wherein the actuators are connected to the common plate on one side of the actuators and to the band-like membrane on an opposite side of the actuators.

18. The keyboard according to claim 12 wherein the actuators and the band-like membrane are positioned between the common plate and the keys.

* * * * *